United States Patent [19]

Farace

[11] Patent Number: 4,470,351

[45] Date of Patent: Sep. 11, 1984

[54] ELECTRONIC TURNS COUNTING SAFETY AND ARMING MECHANISM

[75] Inventor: Louis P. Farace, Mesa, Ariz.

[73] Assignee: Motorola Inc., Schaumburg, Ill.

[21] Appl. No.: 411,740

[22] Filed: Aug. 26, 1982

[51] Int. Cl.[3] ..... F42C 15/40

[52] U.S. Cl. ..... 102/232; 102/215; 102/262

[58] Field of Search ..... 102/262, 264, 231, 232, 102/233, 215, 206

[56] References Cited

U.S. PATENT DOCUMENTS

| | | | |
|---|---|---|---|
| 3,353,487 | 11/1967 | Perryman | 102/215 |
| 3,670,655 | 6/1972 | Krupa | 102/238 |
| 3,699,892 | 10/1972 | Kopec et al. | 102/264 |
| 3,750,583 | 8/1973 | White et al. | 102/215 |
| 3,853,062 | 12/1974 | Cole | 102/215 |
| 3,890,901 | 6/1975 | Anderson et al. | 102/264 |
| 3,964,396 | 6/1976 | Herold et al. | 102/238 |
| 3,972,290 | 8/1976 | Czajkowski et al. | 102/238 |
| 4,051,339 | 9/1977 | Will et al. | 102/264 |
| 4,145,971 | 3/1979 | Graham et al. | 102/232 |

*Primary Examiner*—Charles T. Jordan
*Attorney, Agent, or Firm*—Eugene A. Parsons

[57] ABSTRACT

A centrifugal rotor operates under the influence of the spin of the fuze to close a switch for a fraction of a fuze revolution. The switch closure controls a counter which counts the cycles of a relatively high frequency oscillator for the fraction of a revolution. This fractional count is multiplied by a constant to attain a required total number of revolutions. A second counter counts the cycles of the oscillator from the time the oscillator is turned on until the total revolution count is attained, at which time the fuze is armed.

10 Claims, 9 Drawing Figures

SAFE

ARMED

ELECTRONIC TURNS COUNTING SAFETY AND ARMING MECHANISM

BACKGROUND OF THE INVENTION

Technology growth in weapon system design has produced remarkable advances in fuzing technology and capability since the Viet Nam war. Improvements in timing accuracy, target detection capabilities and target impact survivability will undoubtedly increase the effectiveness of large caliber munitions on the battlefields of the future. Unfortunately there exists one common area of fuze technology which, though better understood and more tediously analyzed than in the past, has failed to keep pace with modern weapons development—the safe and arming (S&A) device. Generally, the S&A device arms the fuze of the projectile at some required distance from the weapon to prevent premature explosion and the consequent damage to weapon and personnel.

Traditionally, the delay in arming of the fuze is accomplished through an electronic timer or by means of a mechanical device. The electronic timer is generally unsatisfactory because at the present time many weapons fire projectiles at varying muzzle velocities. Thus, a fixed time electronic timer would arm the fuze at different distances from the muzzle of the weapon, depending upon the muzzle velocity. One of the prime objectives of S&A devices is to arm the fuze at a constant required distance from the muzzle of the weapon. Mechanical S&A devices generally are limited to clockwork forms. Logistic considerations and concern during the Viet Nam conflict led to intensive investigations into alternatives to horological components to achieve arming delay. Mobilization concerns also prompted investigations into alternative methods of manufacture for pinions as a second approach to the precision component problem. While all these efforts have served to aleviate the problem somewhat, the net result has been to retain clockwork forms in S&A's simply because it is not practical to achieve meaningful time delay with ball rotors, sliders, unwinding ribbons, or mass transfer devices.

Clockwork mechanisms used in S&A's generally involve the use of runaway escapements, which when coupled to a centrifugal gear output produce a turns-counting effect in a spinning fuze. Experimentation with such devices usually results in the realization that a definite upper limit exists for arming delay for a given fuze volume. Experimentation to date seems to indicate that a realistic upper limit for runaway escapement devices in approximately a 1.3 inch diameter is somewhere between 30 and 35 turns. Longer delays may be feasible, but require either very precise control over lubrication or attendant losses in reliability. Friction becomes the main deterrent in any attempt to significantly improve arming delay in a mechanical device. Motion of a runaway escapement system is purely a matter of net torque about the pivot of the mechanical oscillator. This net torque represents the difference between applied torque from the escape wheel and pivot friction losses from the last journal bearing. Unfortunately, both of these factors are proportional to centrifugal force. Hence, a marginal design is really no better off from a reliability standpoint at a high spin than at low. Designs in which the net torque at the final stage are near zero fall prey to friction sensitivity and perform poorly in mass production. New hypervelocity weapons employing high fragmentation steel alloys could easily require substantially increased safe separation to maintain gun crew safety at present levels. A similar argument can be made for the trend toward higher spin rates in future munitions. Known wear problems and gear distortion are evident in spin regimes below 20,000 rpm with the present die-cast gears; and yet future spin rates for large caliber weapons progressively rise toward 30,000 rpm, an environment producing more than double the gear and escapement loads presently experienced.

SUMMARY OF THE INVENTION

The present invention pertains to a safe and arming mechanism for a fuze to be used with spinning explosive projectiles wherein a centrifugal switch is constructed to operate over a fraction of a revolution of the fuze to allow the fraction of a revolution to be converted to a time measurement, which time measurement is then expanded electronically to a predetermined number of revolutions. This expanded time provides an indication of the real time that it will require for the projectile to reach the desired distance from the weapon. Time of flight is measured from the time of firing the weapon and when the time of flight corresponds with the expanded time the fuze is armed.

It is an object of the present invention to provide a new and improved turns counting safe and arming mechanism for a fuze to be used with spinning explosive projectiles.

It is a further object of the present invention to provide a safe and arming mechanism for a fuze which accurately measures arming times in spite of variations in muzzle velocity and spin rates.

It is a further object of the present invention to provide a safe and arming mechanism utilizing a single unencumbered rotor element for greater consistency and reliability than current mechanical safe and arming devices having escapements and gears.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the figures.

DESCRIPTION OF THE PREFERRED EMBODIMENTS

Figure 1:
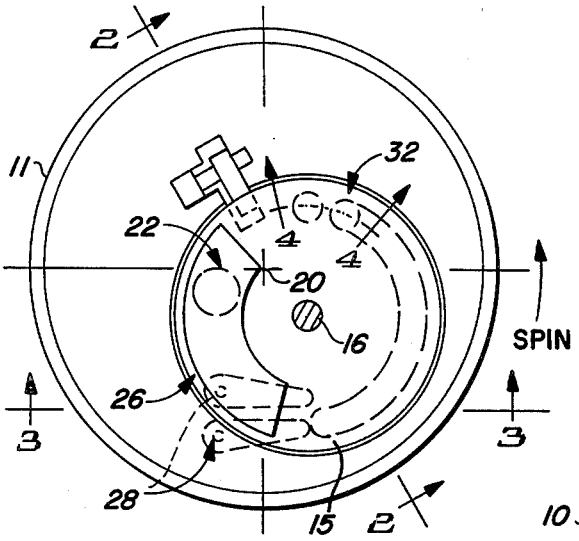
FIG. 1 is a view in top plan of a centrifugal switch which forms a portion of a safe and arming mechanism embodying the present invention.
Figure 3:
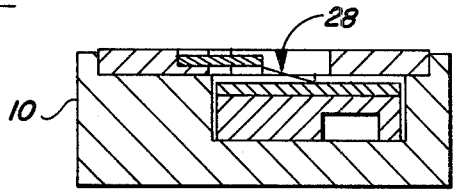
FIG. 3 is a sectional view taken along the line 3—3 in FIG. 1.
Figure 2:
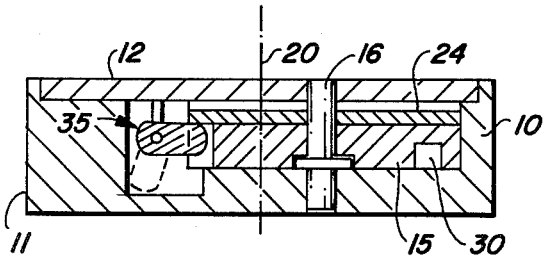
FIG. 2 is a sectional view taken along the line 2—2 in FIG. 1.
Figure 4:
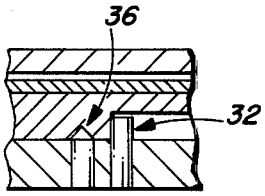
FIG. 4 is a partial sectional view as seen from the line 4—4 in FIG. 1.

In the preferred embodiments of the present invention a switch is illustrated which utilizes a centrifugal rotor, because of its simplicity of construction and because its response is easy to measure. However, many other inertial elements could also be utilized, i.e., a ball rotor, a disc rotor, a slider, or an unwinding ribbon. All of these devices exhibit a double integrating response, even though it is for a very short period of time. Further, while a variety of arming mechanisms might be utilized with the centrifugal switch, the specific mechanism contemplated in this disclosure is the mechanical portions of the S&A mechanism illustrated in U.S. Pat. No. 4,145,971, issued Mar. 27, 1979, entitled "Electronic Time Delay Safety and Arming Mechanism", the mechanical apparatus of which is incorporated herein by reference.

Referring specifically to FIG. 1-4, a centrifugal switch is illustrated including a generally cylindrical, pillbox shaped housing 10. The housing 10 includes a base portion 11 and a flat disc-shaped cover 12. It should be noted that the cover 12 is removed from the base 11 in FIG. 1 to better illustrate the inner components of the switch. A generally circularly shaped well is formed in the housing 11 in upwardly opening relationship so that it is completely sealed when the cover 12 is properly positioned with respect to the base portion 11. A centrifugal rotor 15 is rotatably mounted in the well by means of an axle 16 extending between the base portion 11 at the bottom of the well and the cover 12. The well and rotor 15 are positioned so that the axle 16 (the axis of rotation for the rotor 15) is parallel with but spaced from a spin axis 20 for the projectile and fuze and, also, the axis of the cylindrical housing 10. The rotor 15 also includes a weight 22 which is positioned so that the center of gravity of the rotor 15 is spaced from the spin axis 20 of the fuze and the axis of axle 16. Thus, the rotor 15 will inherently spin under the influence of the spinning of the fuze after firing of the projectile.

In this embodiment the rotor 15 is a generally circular disc formed of some electrically nonconducting material, such as plastic or the like and the upper surface thereof is formed of printed circuit board material 24. A contact strip 26 of electrically conducting material, such as copper or the like, is formed on the upper surface of the printed circuit board 24. The printed circuit board 24 is utilized for ease in forming the contact strip thereon and it will be understood by those skilled in the art that many other embodiments might be utilized. The contact strip 26 is generally arcuate shaped and in this embodiment is approximately 120 degrees (of the rotor 15) in length. A pair of spring-loaded contacts 28 are affixed to the cover 12 and extend downwardly into the well to slidingly engage the upper surface of the rotor 15. In the unarmed position, the rotor 15 is positioned so that the contacts 28 are disengaged from the contact strip 26.

Figure 5:
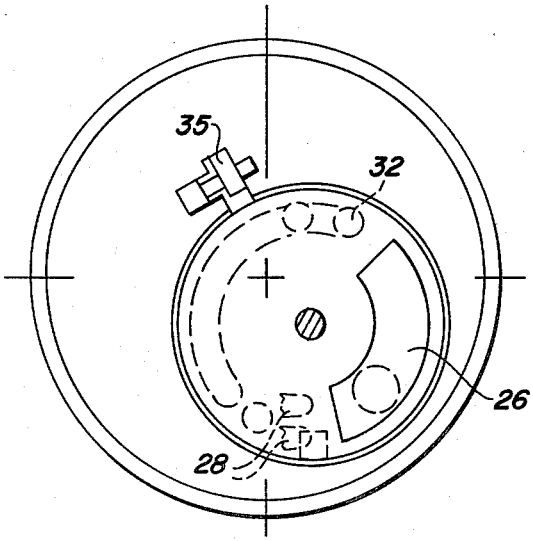
FIG. 5 is a view in top plan similar to FIG. 1 with the switch moved to a final position after completion of the switch cycle.

An arcuate groove 30 is formed in the lower surface of the rotor 15 and a stop pin 32 extends upwardly from the bottom of the well in the housing 10 into the groove 30 to limit rotary movement of the rotor 15. The groove 30 extends approximately 150 degrees and the pin 32 is positioned at one end of the groove in the unarmed position (see FIG. 1) and stops rotation of the rotor 15 when it strikes the other end of the groove 30 (see FIG. 5).

A slot is formed in the base portion 11 in communication with the well in which the rotor 15 is mounted. The slot extends radially outwardly from the well and a communicating slot is formed in the rotor 15. A setback lever 35 is pivotly mounted in the slot and is spring biased upwardly so as to extend into the slot in the rotor 15 to hold it in the position illustrated in FIG. 1 and 2. During setback the lever 35 pivots downwardly (illustrated in dotted lines in FIG. 2) and under the influence of the spinning projectile the lever is maintained in the downward position so that the rotor 15 is free to rotate. It will of course be understood that many other types of setback and spin devices may be utilized to prevent rotation of the centrifugal switch until the desired time, but the present one is illustrated because of its simplicity and ease of manufacture. In addition to the above described setback lever 35, a conically shaped pin 36 extends into the well of the base portion 11 and engages a dimple in the bottom surface of the rotor 15 in the unarmed position illustrated in FIG. 1. The rotor 15 requires creep acceleration to lift the lower surface thereof forward to clear the pin 36 which precludes rotor 15 rotation in the setback position. The pin 36 along with the high thrust loads of the setback environment delay the initial switch closure until muzzle exit.

Thus, the rotor 15 is unbalanced with respect to its axle or pivot 16, inducing a moment in combination with the centrifugal force acting at the wheels center of gravity. This moment produces a counterclockwise rotation of the rotor 15 until the center of gravity reaches an orientation maximizing its position from the spin center. The contacts 28 are finger-like contacts, formed of a springy material, that protrude from the upper cover 12 and are arranged so that both contacts 28 engage the copper strip 26 simultaneously and, therefore, are shorted together. As the rotor 15 rotates in response to centrifugal force, the conducting strip 26 comes into electrical contact with the contacts 28 and produces switch closure. The subsequent rotation of the rotor 15 eventually brings it to a position illustrated in FIG. 5 wherein the switch again opens completing its measurement function. Since the fraction of a revolution the rotor 15 takes to turn through its switch closure position is independent of spin rate, the net result of the rotor 15 response becomes the generation of a closure window one-quarter, or any other predertermined fraction, of a turn wide.

Figure 6:
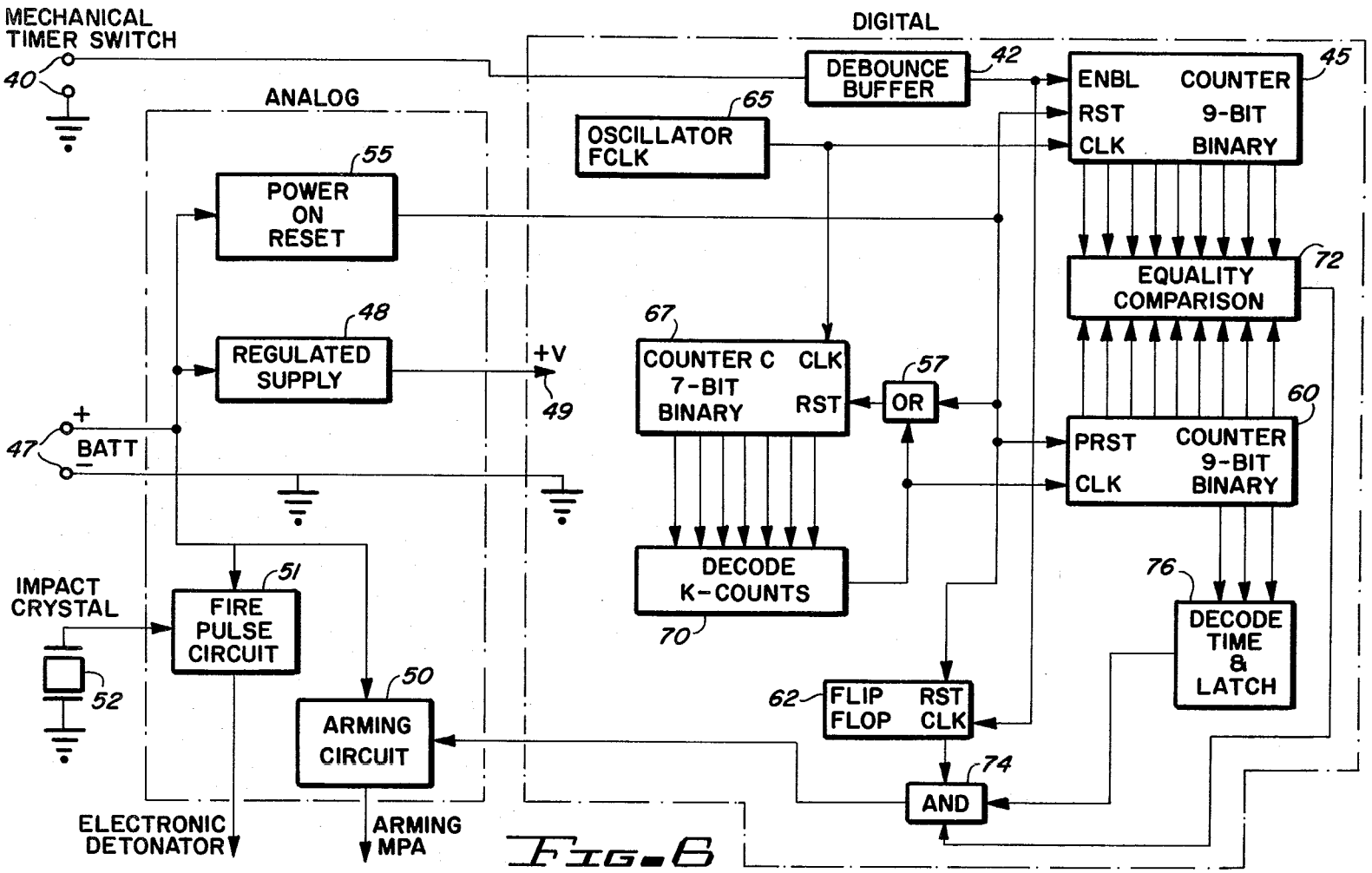
FIG. 6 is a block diagram of the electronics associated with the centrifugal switch of FIG. 1 to form the safe and arming mechanism.

Referring specifically to FIG. 6, a block diagram of the electronics associated with the centrifugal switch is illustrated. The block diagram of FIG. 6 is divided into analog and digital functions although the circuitry is implemented with a single custom IC. The contacts 28 of the centrifugal switch are connected to a pair of input terminals 40, one of which is connected to the common (or to a voltage source if the IC is constructed to require a positive pulse). The other terminal 40 is connected through a debounce buffer circuit 42 to the enable input of a 9 bit binary counter 45. A pair of power terminals 47 are adapted to be connected to a setback and spin actuated power source (not shown) such as the various deferred action batteries well known in the art. The positive terminal 47 is connected through a regulated supply circuit 48 to a positive voltage terminal 49, which supplies positive voltage for the various digital circuits and will not be discussed in detail. The positive voltage terminal 47 also supplies power to an arming circuit 50 which, upon receiving an arming control signal input, supplies power to a miniature piston actuator (MPA) the operation of which is described in detail in the above referenced U.S. Pat. No. 4,145,971. The positive power terminal 47 is also connected to a fire pulse circuit 51 which supplies power to an electric detonator (not shown) when a detonation input signal is received, for example, from an impact crystal 52. The positive voltage from the input terminal 47 is also supplied to a power-on reset circuit 55. Reset circuit 55 holds all circuitry connected thereto in an initial state until the battery (or power source connected to the terminals 47) rises to a predetermined voltage. The power-on reset circuit 55 is connected to a reset terminal of the counter 45, an OR gate 57, the reset of a 9-bit binary counter 60, and to the reset of a flip flop circuit 62.

An oscillator 65 provides relatively high frequency clock pulses to the clock input of the counter 45 and to the clock input of a 7-bit binary counter 67. The outputs of the counter 67 are supplied to a decoder 70, the output of which is applied to the clock input of the counter 60 and to the OR gate 57. The output of the OR gate 57 is connected to the reset input of the counter 67. Outputs of the counters 45 and 60 are supplied to a comparator 72, the output of which is connected to an AND gate 74. Certain outputs of the counter 60 are also connected to a decode time and latch circuit 76, the output of which is connected to a second input of the AND gate 74. A third input of the AND gate 74 is connected to the output of the flip flop 62. The AND gate 74 supplies the arming control signal to the arming circuit 50.

In general, it is desired to generate an arming control signal referenced from $T_o$ at setback, given by $$t_{arm}=K\Delta t_{sw} \tag{1}$$

where K is an integer between 1 and 127, and $\Delta t_{sw}$ is a time interval measured by the centrifugal switch. This represents the time equivalent to a known fraction of a single projectile revolution.

The operation of the circuitry of FIG. 6 is as follows. All digital circuitry connected to the power on reset 55 is held in an initial state until the battery rises to a predetermined voltage $V_1$. The level $V_1$ is chosen such that the battery will be at an adequate voltage to operate the electronics reliably. The time at which the battery reaches $V_1$ is denoted as $t_{BR}$, at $t_{BR}$, counters 60 and 67 are enabled and counter 67 increments its count at a rate equivalent to the frequency of the oscillator 65. The decoder 70 essentially divides the output of the counter 67 by K and each time the counter 67 reaches the value of K a pulse is supplied by decoder 70 to counter 60. Thus, counter 60 increments its count at a rate $f_{cl}/K$. Counter 60 has the additional property of being preset to some initial count, $N_B$ (init), which will be described presently. Thus, at any given time, t, the total count present in counter 60 is given by:

$$N_B=(t-t_{BR})f_{cl}/K+N_B(\text{init}) \tag{2}$$

at time $t=t_{swl}$, counter 45 is enabled and is clocked at a rate $f_{cl}$. The time $t_{sw1}$ is the time when the centrifugal switch first closes. At $t=t_{sw2}$ (the centrifugal switch opens ¼ turn later), counter 45 is disabled and retains a count given by $$N_A=f_{cl}(t_{sw1}-t_{sw2})=f_{cl}\Delta t_{sw} \tag{3}$$

An arming control signal will now result when counter 60 achieves the count stored in counter 45 so that a comparison can be made in comparator 72. Equating equations 2 and 3 and solving for t yields:

$$t=t_{arm}=K\Delta t_{sw}=t_{BR}-\frac{K}{f_{c1}}N_B(\text{init}) \tag{4}$$

Presuming that $t_{BR}$ can be predicted, $N_B$ (init) can be chosen such that:

$$t_{BR}-\frac{K}{f_{c1}}N_B(\text{init})=0 \tag{5}$$

$$N_B(\text{init})=\frac{f_{c1}}{K}+t_{BR}$$

For these conditions, the desired arming time expressed in equation 1 results. It is important to note that the arming time generated in this manner is essentially independent of the frequency of the oscillator 65. The example below illustrates how this arming time approach would operate in a weapon having the specified characteristics.

Given:
spin rate=2950 RPM,
muzzle velocity=810 ft/sec,
desired arming time=550 msec. (27 revolutions), and
desired arming distance=450 ft.
Design parameters:
K=108,
$f_{cl}$=100 KHz,
$N_B$(init)=2 counts, and
$\Delta t_{sw}$=5.1 msec.
Assume: $t_{BR}$=2 msec.
Substituting into equation (4) gives:
$t_{arm}$=(108)(5.1 msec)+(2 msec
−108/100KHZ)(2)
=550.8 msec.
since the number of projectile turns=RPS×$t_{arm}$;
N=27.08 turns.

This result is within 0.2% of the desired arming time. The primary limitation of the arming time accuracy is imposed by the fact that K can only assume integer values. Ideally, for the example given above, K would assume the value 107.8. It should be noted here that this constant is preset by the design of the electronics and is chosen to be compatible with the response of the rotor 15.

Along with the basic arm timing functions, two features intended as safety measures are included in the digital logic circuitry of FIG. 6. The first, a fail safe measure, includes flip flop 62 which senses the transition of the centrifugal switch. In the event that the centrifugal switch does not operate properly and this transition is not sensed, any arming command will be inhibited since the correct output signal will not be supplied to the AND gate 74. The S&A will therefore remain in a safe condition. The second feature is the decode time and lapse circuit 76. The output from this circuitry is also supplied to the AND gate 74 and will inhibit any arming command prior to some minimum time which is determined by the output of the counter 60 and the connections thereof to the circuit 76.

Figure 7:
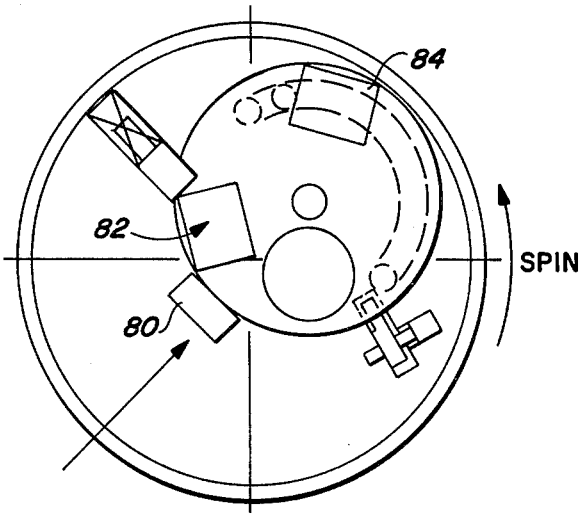
FIG. 7 is a view in top plan of another embodiment of a centrifugal switch.
Figure 8:
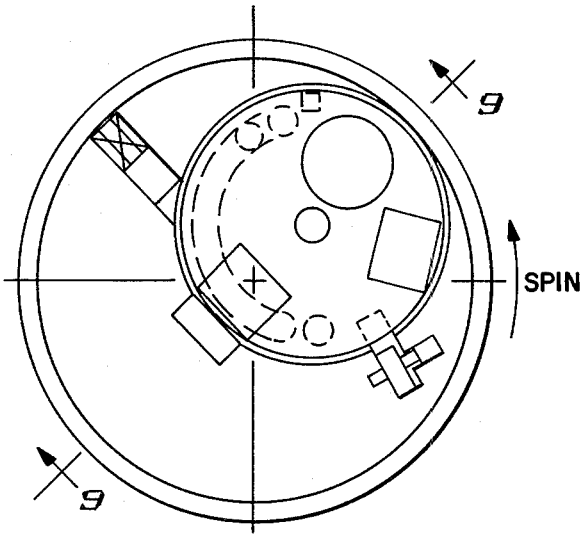
FIG. 8 is a view in top plan of the centrifugal switch of FIG. 7 in its final position after firing.
Figure 9:
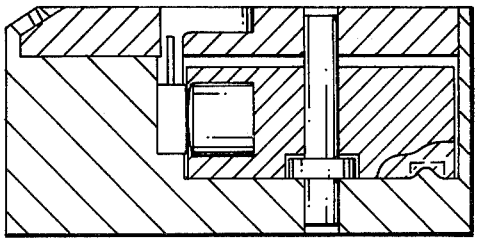
FIG. 9 is a sectional view as seen from the line 9—9 in FIG. 8.

A different embodiment of a centrifugal switch is illustrated in FIGS. 7 through 9. This particular embodiment is a noncontact switch using a Hall effect sensor to sense rotation of the rotor. The housing and rotor are constructed as described in conjunction with FIGS. 1 through 5. A Hall effect device 80 is mounted on the housing so as to be in juxtaposition to the rotor. The Hall effect device 80 senses the presence of either of two small magnets 82 and 84 embedded in the rotor wheel in spaced apart relationship and shorts two terminals of an electronic circuit embedded in the device. The Hall effect device 80 is capable of sensing magnetic presence at a stand-off of approximately 0.020 inches depending on the field strength. The two magnets 82 and 84 generate a make-break-make-break sequence requiring complementing electronic circuitry to measure time between each make to generate the fractional turn window. A simple bistable circuit connected to receive the pulses from the terminals 40, in FIG. 6, would convert the circuitry to use with this Hall effect sensor embodiment.

Thus, an improved electromechanical S&A mechanism is disclosed which is not subject to the upper limit and torque problems of the prior art, described above. The turns delay is provided electronically and has no upper limit other than battery life (already demonstrated to exceed 100 seconds in current electronic fuzes). The rotor element disclosed, without the drag of a gear train and escapement tied onto it, provides a margin of driving torque orders of magnitude above that of a rotor gear with escapement or linkage attachment as utilized in prior art S&A's. The use of a singular rotor element as the switch function also significantly alleviates the eccentric spin problem. Because of the reduction in moving parts and the consequent elimination of wear points which are seriously degraded at lower spin rates (approximately 20,000 rpm), the present S&A functions reliably well above 30,000 RPM spin levels.

While I have shown and described specific embodiments of this invention, further modifications and improvements will occur to those skilled in the art. I desire it to be understood, therefore, that this invention is not limited to the particular forms shown and I intend in the appended claims to cover all modifications which do not depart from the spirit and scope of this invention.

I claim:

1. A safe and arming mechanism for a fuze to be used with spinning explosive projectiles having a spin axis, said mechanism comprising:

a housing;

a movable member mounted within said housing for movement about an axis parallel with the spin axis of the projectile, said movable member having a center of gravity displaced from the spin axis of the projectile for producing a moment tending to cause movement of said movable member during spinning of the projectile;

sensing means mounted in juxtaposition with said movable member for sensing a predetermined amount of movement of said movable member and providing an electrical signal indicative of the time required to complete the predetermined amount of movement; and electronic circuitry connected to receive the electrical signal from said sensing means and provide an arming signal subsequent to a period of time equivalent to a predetermined factor multiplied by the time indicated by the electrical signal.

2. A safe and arming mechanism for a fuze to be used with spinning explosive projectiles having a spin axis, said mechanism comprising:

a housing;

a rotatable member mounted within said housing for rotational movement about an axis parallel with the spin axis of the projectile, said rotatable member having a center of gravity displaced from the spin axis of the projectile and the spin axis of said rotatable member for tending to cause rotation of said rotatable member during spinning of the projectile;

sensing means mounted in juxtaposition with said rotatable member for sensing a predetermined amount of rotation of said rotatable member and providing an electrical signal indicative of the time required to complete the predetermined amount of rotation; and electronic circuitry connected to receive the electrical signal from said sensing means and provide an arming signal subsequent to a period of time equivalent to a predetermined factor multiplied by the time indicated by the electrical signal.

3. A safe and arming mechanism as claimed in claim 2 wherein the sensing means includes conductive material on a surface of the rotatable member and at least one electrical contact mounted to complete a circuit at approximately the beginning of rotation of the rotatable member and at the completion of the predetermined amount of rotation.

4. A safe and arming mechanism as claimed in claim 3 wherein the conductive material is formed into an arcuate strip having a length approximately equal to the predetermined amount of rotation and a pair of sliding electrical contacts are fixedly attached to the housing for sliding engagement with the conductive material.

5. A safe and arming mechanism as claimed in claim 2 wherein the sensing means includes a pair of magnets affixed to the rotatable member and spaced apart a distance equivalent to the predetermined amount of rotation and a Hall effect device is affixed to the housing adjacent the rotatable member for passage of said magnets into an operative position adjacent said Hall effect device during rotation of said rotatable member.

6. A safe and arming mechanism as claimed in claim 2 wherein the electronic circuit includes an oscillator having an output and a counter connected to receive the oscillator output and further connected to the sensing means for being enabled by the electrical signal therefrom.

7. A safe and arming mechanism as claimed in claim 6 wherein the electronic circuit further includes counting apparatus connected to the oscillator for counting the oscillator output from approximately a starting time of said oscillator, and a comparator connected to the counter and to the counting apparatus for providing an output signal when the count in the counting apparatus compares to the count in the counter.

8. A method of safeing and arming a fuze to be used with spinning explosive projectiles having a spin axis comprising the steps of:

determining the length of time required for the projectile to spin through a predetermined fraction of a revolution;

expanding the length of time by a predetermined constant to obtain a desired arming time; and initiating arming when the desired arming time occurs.

9. A method as claimed in claim 8 wherein the step of determining the length of time includes providing an oscillator, a counter, and a switch that operates at least at the extremes of the predetermined fraction of a revolution; starting the oscillator to provide output cycles; and operating the counter with the switch to count the oscillator cycles only during the predetermined fraction of a revolution.

10. A method as claimed in claim 9 wherein providing a switch that operates at least at the extremes of the predetermined fraction of a revolution includes mounting a member, having a center of gravity displaced from the spin axis of the projectile, for rotation about an axis parallel to the spin axis; providing a switch operating structure at least at the beginning and end of a distance on said member equivalent to the predetermined fraction of a revolution; and mounting switching structure adjacent the member for responding to the switch operating structure.

* * * * *